US010100451B2

(12) United States Patent
Bellini

(10) Patent No.: US 10,100,451 B2
(45) Date of Patent: Oct. 16, 2018

(54) MACHINE AND PROCEDURE FOR THE DYEING OF REELS OF YARN AND/OR TEXTILE FIBRES WOUND ON PACKAGES

(71) Applicant: Innovation & Research S.R.L., Milan (IT)

(72) Inventor: Giovanni Bellini, Garbagnate Milanese (IT)

(73) Assignee: INNOVATION & RESEARCH S.R.L., Milan (IT)

( * ) Notice: Subject to any disclaimer, the term of this patent is extended or adjusted under 35 U.S.C. 154(b) by 127 days.

(21) Appl. No.: 14/712,534

(22) Filed: May 14, 2015

(65) Prior Publication Data

US 2015/0247273 A1 Sep. 3, 2015

Related U.S. Application Data

(62) Division of application No. 13/997,487, filed as application No. PCT/IB2011/055947 on Dec. 23, 2011.

(30) Foreign Application Priority Data

Dec. 27, 2010 (IT) ..... MI2010A2407

(51) Int. Cl.
*D06B 1/08* (2006.01)
*D06B 5/16* (2006.01)

(52) U.S. Cl.
CPC ..... *D06B 5/16* (2013.01); *D06B 1/08* (2013.01)

(58) Field of Classification Search
CPC ..... D06B 5/16; D06B 1/08
See application file for complete search history.

(56) References Cited

U.S. PATENT DOCUMENTS

| | | | |
|---|---|---|---|
| 1,844,799 | A | 2/1932 | Schroeder |
| 2,429,283 | A | 10/1947 | Veyt |
| 2,577,727 | A | 12/1951 | Abbott |
| 3,751,223 | A | 8/1973 | Bergholtz |
| 3,908,409 | A | 9/1975 | Nielsen |
| 2004/0139769 | A1 | 7/2004 | Ronchi |

FOREIGN PATENT DOCUMENTS

| | | | |
|---|---|---|---|
| FR | 2 429 283 | | 1/1980 |
| FR | 2 573 100 | | 5/1986 |
| GB | 1 405 490 | A | 9/1975 |
| GB | 1405490 | * | 9/1975 |
| SU | 1594229 | A1 | 9/1990 |

OTHER PUBLICATIONS

International Search Report dated Mar. 1, 2012 in PCT/IB11/55947 filed Dec. 23, 2011.
Decision to Grant dated Dec. 1, 2015 in Russian Patent Application No. 2013131764/12(047470) (with partial English language translation).

* cited by examiner

*Primary Examiner* — Amina S Khan
(74) *Attorney, Agent, or Firm* — Oblon, McClelland, Maier & Neustadt, L.L.P.

(57) ABSTRACT

A machine dyeing reels of yarn and textile fibers wound on packages, including: a structure delimiting a chamber partially or fully filled with a dyeing fluid; a support immersed in the dyeing fluid; a plurality of reel-holder rods that communicate via the fluid with the support to allow the dyeing fluid to pass the support; first and second recirculation mechanisms associated with the structure, to initiate transit of the dyeing fluid in accordance with at least one set route. The first recirculation mechanism interposed between the chamber and the support induces the dyeing fluid to pass through the reel-holder rods and includes a pump and respective selection mechanisms to intermittently channel the dyeing fluid through the support, the reel-holder rods, and the respective reels. The second recirculation mechanism induces transit of the dyeing fluid within the chamber in accordance with at least one closed route.

7 Claims, 2 Drawing Sheets

MACHINE AND PROCEDURE FOR THE DYEING OF REELS OF YARN AND/OR TEXTILE FIBRES WOUND ON PACKAGES

CROSS-REFERENCE TO RELATED APPLICATIONS

This application is a divisional of U.S. application Ser. No. 13/997,487, filed Jun. 24, 2013, which is the National Stage of PCT/IB11/055947, filed Jan. 23, 2011, and which claims priority to Italian Patent Application No. MI2010A 002407, the entire content of which is incorporated herein by reference.

FIELD OF THE INVENTION

This invention relates to a machine for the dyeing of reels of yarn and of textile fibre wound on packages. A further aspect of this invention is a procedure for the dyeing of reels of yarn and/or of textile fibre wound on packages.

BACKGROUND OF THE INVENTION

This invention is suitable for use systems and machines for the industrial dyeing of reels of yarn and/or textile fibre wound on packages. For the sake of brevity, the term reel of yarn shall hereinafter always refer to a generic textile material that can include the various textile materials as set out above.

As is known, traditional machines for the dyeing of traditional reels of yarn, operate with the material fully or partially immersed in the dye bath.

Circulation of the dye bath through the material is such as to allow the best possible distribution of the dyeing fluid on the yarn being dyed.

The machine is also equipped with dyeing fluid recirculation means to forcibly induce the latter into transit according to a closed route that always involves passing through the reels of yarn being dyed. The direction of the dyeing fluid through the reels of yarn can also be inverted in accordance with standard timeframes and methods.

As described and illustrated in the MI2004A002124 document filed by the same Applicant, the recirculation means can also be equipped recirculation mechanism that is operatively placed within the machine chamber to ensure continuous movement of the dye bath. Although machines for the dyeing of reels of yarn are capable of high-quality dyeing, the Applicant has found that they are nevertheless not free of drawbacks and can be improved in various aspects, primarily in relation to the significant flow rate of the dyeing fluid when in movement, the high differential pressures that the circulation pump must generate to guarantee the required flow rate, the high level of electricity required, the uniformity of the concentration of colour on the yarn, the adjustment and uniformity of the temperature of the dye bath and the presence of deviation devices that reduce the overall performance of the pumps.

In particular, the Applicant has found that circulation within the dye bath must have an substantially high flow rate.

Homogeneity of dye bath temperature and the concentration of colour on all parts of the yarns being dyed is normally guaranteed via the execution of a high number of dye bath refills per minute, such as two to four bath refills per minute.

So as to ensure optimal colouring of the material, the circulation pumps must generate a significant differential pressure, of between 0.5 bar and 1.5 bar and high flow rates, for example.

Naturally, if the material being dyed has material characteristics that result in its preventing the dyeing fluid from forcibly passing through it, such as polyester or cotton for example, a circulation pump with a fairly high level of power must be used. In the case of more delicate materials, such as cashmere, fibres in top form and silk for example, the circulation flow rate of the dyeing fluid must be restricted. In this event, the input power is reduced in proportion to the reduction in the number of dye bath refills per minute.

In order to reduce the power requirements for the passing of dyeing fluid through the material to be dyed, without excessively compromising machine productivity, it has been proposed that the dyeing fluid not be supplied to all the reel-holders rods in the bath at the same time, but that it be supplied selectively and sequentially to a small part of the total number or said reel-holder rods.

This technology is illustrated in documents FR2429283 and U.S. Pat. No. 3,751,223 for example. The reel-holder rods are subdivided in groups and each group's supply is connected to a separate collector chamber. The circulation pump collects liquid from the container to sequentially transmit it to each collector chamber at an adequate pressure.

Tests conducted by the Applicant have shown a drawback of this technology that is perfectly justified from examination of its fluid-dynamic characteristics. Pump capacity is decreased to only a fraction of the capacity that would be required to simultaneously supply all the reels, with the same unit capacity in terms of passing through the material to be dyed, which is also imposed by its intrinsic characteristics. This reduction in the capacity of the circulating liquid leads to particularly poor circulation and movement of the liquid in which the reels are immersed.

This necessarily results in non-uniformity of distribution of both the concentration of dye in the bath in which the product to be dyed is immersed and the temperature of the liquid itself. Both these parameters result in the transfer of the colouring substance dispersed in the product so that the resulting unacceptable non-uniformity of dyeing of the product, achieved using machines of the type described in the prior documents as referred to above, is justified. This drawback appears to justify that there are no dyeing systems of this type currently in use or on the market, many years subsequent to the relevant theoretical proposal.

Surprisingly, the Applicant has now found that this drawback of the prior art has been overcome via the simple combining of the selective and sequential supply of liquid with a reasonable number of groups of reels with the adoption of means suitable for inducing recirculation or mixing of the liquid within the bath to the extent that it substantially maintains unaltered the characteristics of the liquid, in terms of the temperature and the concentration of the dyeing substance that it contains.

The completely satisfactory result achieved in terms of the dyeing uniformity with a machine according to the invention is not fully justifiable, as shown by the Applicant's tests. It could have been envisaged that a sufficiently powered recirculation of the dyeing fluid within the bath to maintain its concentration and temperature characteristics could have some advantageous effects, both in terms of the uniformity of exposure to the dye of the reels that the dyeing fluid is momentarily not passing through, and in that the characteristics of the liquid that the circulation pump collects from a certain point of the container, to then channel within the reels of material to be dyed, do not result modified by localised.

However, in tests, the combination of the sequential supply of groups of reels in a bath maintained in energetic circulation, resulted in unexpected qualitative results that are not inferior or are indeed superior to the results achieved by traditional machines, where the liquid is supplied to all the reels at the same time and passes through all the material to be dyed at the same time with an energy input that is many times in excess of the requirements of the machine according to the invention.

SUMMARY OF THE INVENTION

One purpose of this invention is thus to provide a of the dyeing machine for reels of yarn that is able to achieve an excellent dyeing result by reducing the flow of the dyeing fluid that is induced to pass through the reels being dyed.

Another purpose of this invention is to provide a machine that requires especially low electric power compared to that required for the operation of the machines of the prior art.

A further purpose of this invention is to achieve dyeing uniformity on all parts of the yarn borne by the reels.

Another purpose of this invention is to provide a machine that is able to ensure dye bath uniformity in any part of the machine.

A final purpose of this invention is to reduce, even slightly, the total cost of the machine for the dyeing of reels of yarn.

The aforementioned purposes, and others still, are substantially achieved by a machine and a procedure for the dyeing of reels of yarn and/or textile fibre wound on packages, as set out and described in the following claims.

BRIEF DESCRIPTION OF THE DRAWINGS

The description of one preferred embodiment of a machine and a procedure for the dyeing or reels of yarn and/or textile fibres wound on packages according to his invention is now provided by way of a non-limiting example. Said description shall be provided hereunder with reference to the annexed drawings, which are provided for illustrative purposes only and are not therefore exhaustive, wherein.

Figure 1:
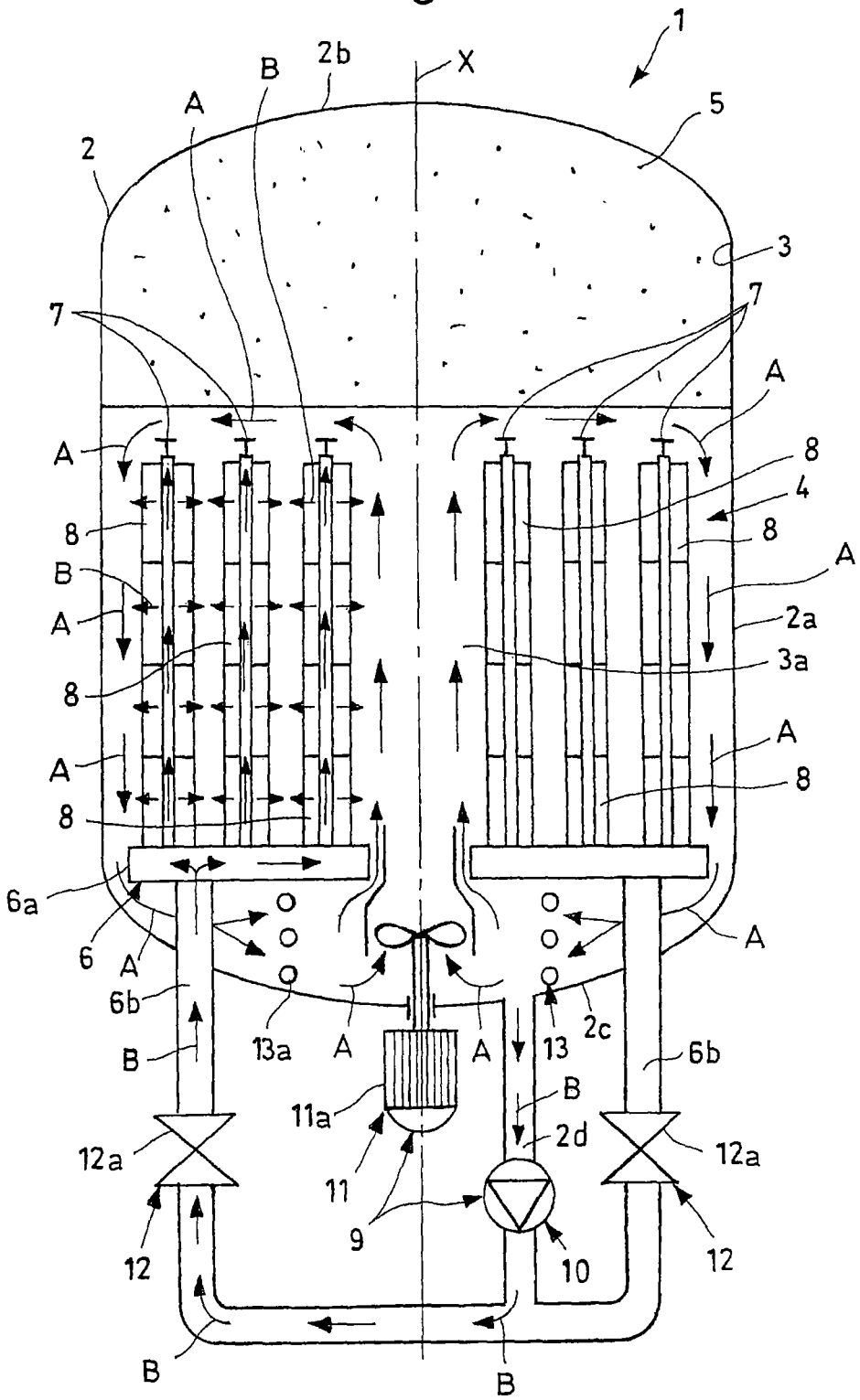
FIG. 1 is a schematic sectional view of a machine for the dyeing of reels of yarn, according to this invention, shown in an initial significant operating position.
Figure 2:
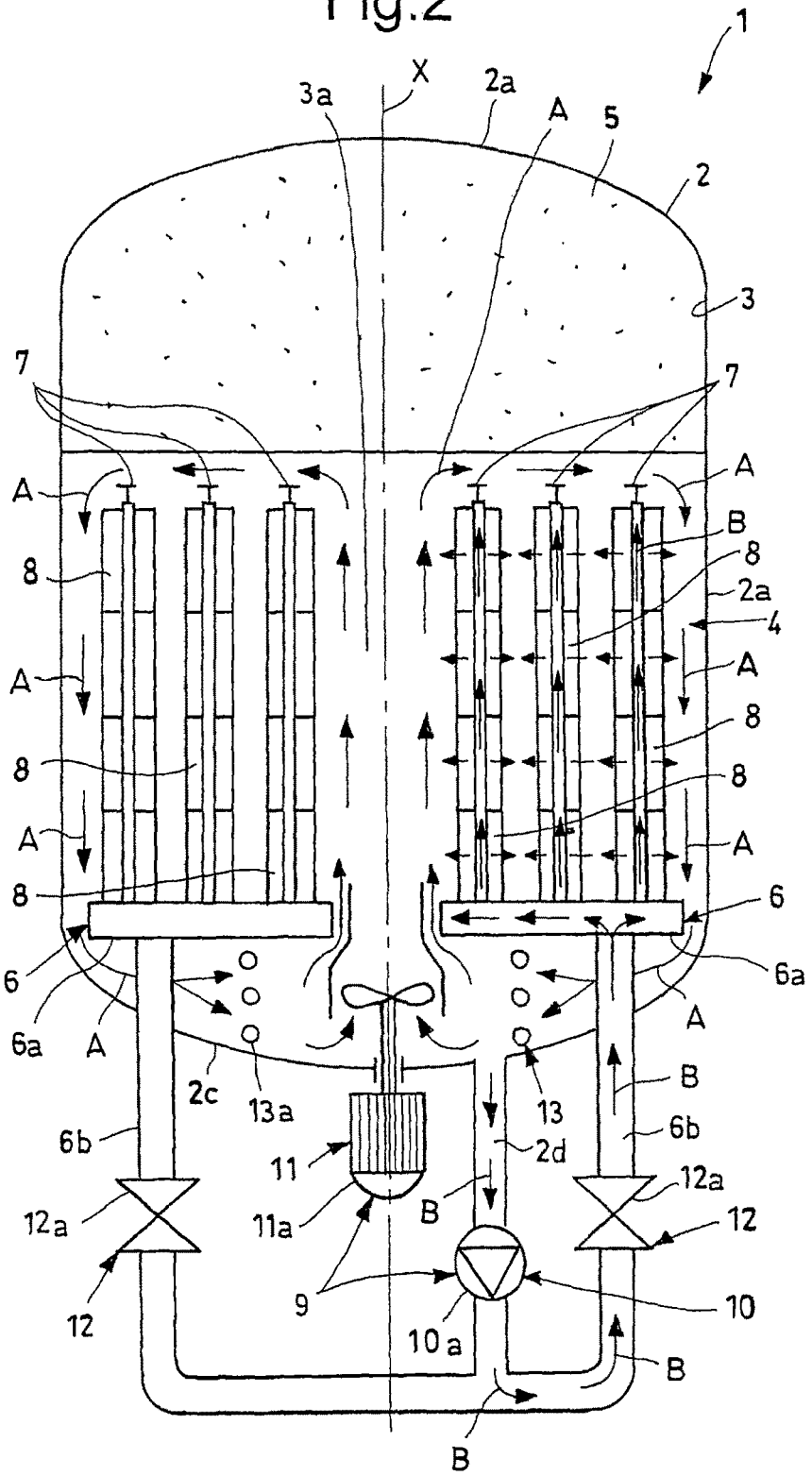
FIG. 2 is a schematic sectional view of the machine pursuant to FIG. 1, shown in a second significant operating position.

With reference to the annexed figures, the number 1 indicates a machine for the dyeing of reels of yarn, according to this invention.

DETAILED DESCRIPTION OF EXAMPLE EMBODIMENTS

As can be seen in the annexed figures, machine 1 comprises a structure 2 that internally delimits a chamber 3, that is at least partially full of at least, one dyeing fluid 4, preferably an aqueous dye solution, the class of which is dependant on the type of fibre to be dyed.

More specifically, structure 2 presents an substantially cylindrical form defined by a respective cylindrical lateral wall 2*a*, the upper and lower parts of which are respectively closed by a first and second arched cover 2*b* and 2*c*.

As illustrated in the annexed figures, structure 2 is substantially vertical, thus the first and second arched covers 2*b* and 2*c* close the lateral cylindrical wall 2*a* in horizontal fashion, from above and from below.

It should be noted that, for the purposes of this invention, the direction of the structure 2, is of no consequence. In fact, the structure 2 may also be horizontal, without this limiting the scope of this invention.

As can be seen in the annexed figures, the dyeing fluid 4 at least partially fills the chamber 3 of the structure 2, provided that the textile material to be dyed is immersed in said dyeing fluid.

Again, with reference to the annexed figures, the chamber 3 of the machine 1 is pressurised via the introduction of a gas 5 that floats above the surface of the dyeing fluid 4, between said dyeing fluid and the first arched cover 2*b* or the structure 2.

As can be seen in the annexed figures, the machine 1 further comprises support means, preferably at least one support plate 6 positioned within the chamber 3. The support plate 6 is situated in proximity of the second arched cover 2*c* of the structure 2 of the machine 1 so that it is completely immersed in the dyeing fluid 4.

The support plate 6 is advantageously hollow to allow the transit of the dyeing fluid 4 along its structure. Again in relation to the annexed figures, the machine 1 comprises a plurality of reel-holder rods 7, which are also substantially hollow and completely immersed in the dyeing fluid 4 of the chamber 3.

The reel-holder rods 7 communicate via the fluid with the support means, in particular with the hollow support plate 6, to allow the transit of the dyeing fluid 4 between them.

More specifically, the reel-holder rods 7 preferably extend in perpendicular fashion from the hollow support plate 6 towards the first arched cover 2*b* of the structure 2 of the machine 1.

When the reel-holder rods 7 are respectively equipped with cylindrical structures with a circular section, each reel-holder rod 7 is equipped with a plurality of perforations (not visible in the annexed figures) that along its longitudinal section, that allow the latter to communicate via fluid with the chamber 3 of the structure 2 of the machine 1.

As schematically shown in the annexed figures, each reel-holder rod 7 axially slots onto at least one reel 8 of yarn and/or to textile fibre wound round a package to be dyed, preferably onto a plurality of reels 8 placed in the form of vertical stacks of textiles. According to the embodiment illustrated in the annexed figures, the hollow support plate 6 has at lest two hollow support parts 6*a*, each equipped with a series of reel-holder rods 7.

The hollow support plate 6 should preferably has a plurality of hollow support parts 6*a*, that are circumferentially distributed around a longitudinal axis X of the structure 2 of the machine 1.

More specifically, each hollow support part 6*a* of the hollow support plate 6 has a plurality of reel-holders 7.

The hollow support parts 6*a* of the support plate 6 are advantageously distanced one from the other in correspondence and/or in proximity of the longitudinal axis X of the structure 2 to delimit an substantially central transport channel 3*a* within the chamber 3. Advantageously, the machine 1 is also equipped with recirculation means 9 of the dyeing fluid 4. The recirculation means 9 are operatively associated to the structure 2 of the machine 1 to put the dyeing fluid 4 into transit according to at least one set route.

In more detail, the recirculation means 9 comprise an initial recirculation mechanism 10 that is operatively interposed between the chamber 3 and the support plate 6 to induce the dyeing fluid 4 to pass through both the reel-holder rods 7, that it supports, and between said reel-holders and the chamber 3.

Advantageously, the first recirculation mechanism 10 comprises at least one pump 10*a*, preferably a centrifugal pump that is operatively placed between the chamber 3 and the hollow support plate 6.

It should however be pointed out that for the purposes of this invention, axial, non-centrifugal pumps or bidirectional pumps that induce the dyeing fluid 4 to move in different directions, can also be used.

As illustrated in the annexed figures, the pump 10*a* is set up to draw the dyeing fluid 4 from the chamber 3 and then re-channel it into the chamber 3 via the hollow support plate 6, the reel-holder rods 7 and the respective reels 8, that are slotted onto said rods.

The pump 10*a* is operational when at least one suction duct 2*d* is in communication with the fluid via chamber 3.

In detail, the suction duct 2*d* extends below the structure 2 away from the latter's second arched cover 2*c*.

The suction duct 2*d* advantageously communicated with the fluid via at least one supply duct 6*b* that extends below each hollow support part 6*a* of the hollow support plate 6. In this way, the first recirculation mechanism 10 also communicates with the fluid via the hollow support parts 6*a* of the hollow support plate 6.

Advantageously, the first recirculation mechanism 10 is set up to and suitable for inducing the dyeing fluid 4 to pass through the respective reel-holder rods 7 and the reels 8 borne by the reel-holder roads 7, on an intermittent basis. In other words, the first recirculation mechanism 10 can be switched between an initial position, in which the dyeing fluid 4 passes through the reels 8 of the respective reel-holder rods 7, and a second position, in which the dyeing fluid 4 does not pass through said reels 8, for a set period of time.

By way of example, the period of time relating to the second position, that is the absence of flow of the dyeing fluid 4 through the reels 8, advantageously comprises 10 to 60 seconds, preferable no less than 5 seconds and, even more preferably, no less than 3 seconds.

In this way, the yarn borne by each reel 8 is engulfed by a continuous flow of dyeing fluid 4 for a set period of time. Subsequently, the yarn borne by each reel 8 is left to soak in the dyeing fluid 4 without any flow, before being again engulfed, after a certain period of time, by another continuous flow of dyeing fluid 4 that is followed by another, renewed dye bath.

Advantageously, the recirculation means 9 comprise a second recirculation mechanism 11, preferably an axial pump that acts as an agitator. The axial pump is operatively associated to the structure 2 to induce the dyeing fluid 4 to move within the chamber 3, according to at least one set route, preferably an substantially closed and/or loop route, as shown by the arrows represented by the letter A in the annexed figures. Alternatively, the second recirculation mechanism 11 can comprise a centrifugal pump that acts as an agitator.

In accordance with a further embodiment of this invention, the recirculation means 9 can also envisage an external suction and pressure pump with pipes placed on the structure 2, that acts as a mixer.

As can be seen in the annexed figures, the second recirculation mechanism 11 is operatively and substantially aligned to the longitudinal axis X of the structure 2 of the machine 1 and/or to the central transit channel 3*a* delimited by the hollow support parts 6*a* of the hollow support plate 6 and by the reel-holder rods 7 thereof.

The movement route of the dyeing fluid 4, determined by the second recirculation mechanism 11, is at least in part, tangential to the reels 8 of yarn, to the reel-holder rods 7 and to the hollow support parts 6*a* of the support plate 6.

In particular, the dyeing fluid 4 circulates within the chamber 3, flowing between the reels 8 and the reel-holder rods 7, both in an substantially vertical and horizontal direction.

Naturally, the recirculation of dyeing fluid 4 within the chamber 3 of the structure 2 of the machine 1 can be carried out according to any known art that allows the dyeing fluid to be continuously mixed around the reel-holder rods 7 and reels 8 borne by said reel-holder rods.

As can be seen in the annexed figures, the recirculation means 9 comprise at least one selection mechanism 12, in particular a valve 12*a* that is operatively interposed between the first recirculation mechanism 10 and at least one reel-holder rod 6. The selection mechanism 12 can be advantageously switched between an open position, in which the first recirculation mechanism 10 induces the dyeing fluid 4 to pass through at least one reel-holder rod 7 and the supported reels 8, and a closed position, in which the dyeing fluid 4 does not pass through said reel-holder rod 7 and the respective supported reels 8.

With reference to the above described hollow support parts 6*a* of the support plate 6, the recirculation means 9 comprise, for each hollow support part 6*a*, a selection mechanism 12 that is operatively interposed between the latter and the first recirculation mechanism 10. In this case, each selection mechanism 12 can be switched between an open position, in which the first recirculation mechanism 10 induces the dyeing fluid 4 to pass through the respective reel-holder rods 7 and the reels 8 borne by said reel-holder rods and a closed position, in which the dyeing fluid 4 does not pass through said reel-holder rods 7 and the respective reels 8.

Advantageously, the machine 1 further comprises at least on control unit (as yet unknown so not shown) that is operatively associated to the selection mechanisms 12 to control the opening and closing movement according to a set schedule. The control unit is set up to switch at least one of the selection mechanisms 12 from an open to a closed position, simultaneously to the switching of another selection mechanism 12 from the closed position to the open position. In this way, the control unit stops the dyeing fluid 4 from flowing through a group of reel-holder rods 7, while at the same time allowing the dyeing fluid 4 to pass through another group of different reel-holder rods 7.

The selection mechanisms 12 can be advantageously switched between the open and closed position in such a way as to allow the flow of dyeing fluid 4 through only one group of reel-holder rods 7 or through a plurality of reel-holder rod 7 groups on an alternating basis. According to this solution, the machine 1 is able to channel a selective and sequential supply of dyeing fluid 4 to groups comprising a reasonable number of reels 8. In this case, it is advantageous that the supply of dyeing fluid 4, through the reels 8 of each group, take place over a relatively short time, in the region of tens of seconds.

Each sequential supply cycle will therefore include the sequential supply of each envisaged group of reels 8, followed by a stasis stage, in which supply to the reels 8 ceases for a period of time that is typically of the same order of magnitude as the supply period, even if it is preferably a few times greater, e.g. around 30 seconds in this case. Advantageously, the period of stasis can therefore be substantially the same as the total supply time allocated to supply fluid to the reels, or of the same order of magnitude.

In the specific event of there being three groups of reels 8, it is therefore preferable that each sequential supply cycle comprises the supply of dyeing fluid 4 to a first group of reels 8, for around 10 seconds, the subsequent supply to a second group of reels 8, in around 10 seconds, the subsequent supply to a third group of reels for around 10 seconds, with the supply of dyeing fluid 4 then being stopped for around 20 seconds for each group of reels 8. In this case, each supply cycle for each group of reels 8 takes around 30 seconds to complete, broken down into 10 seconds of supply and 20 seconds of stasis.

The above values are provided for illustrative purposes only and are merely mentioned as verified during tests as adequate for a satisfactory treatment that reaps the benefits of the invention.

As can be seen in the annexed figures, each valve 12*a* of each selection mechanism 12 can be switched between a closed position, in which it does not permit the transit of the dyeing fluid 4 originating from the pump 10*a* along the respective supply duct 6*b*, and an open position, in which it permits the transit of the dyeing fluid 4 originating from the pump 10*a*, along the respective supply duct 6*b*.

When a valve 12*a*, of a respective selection mechanism 12, is in the open position, the dyeing fluid 4 being drawn in through the suction duct 2*d*, is channelled, as represented by the B arrows in the annexed figures, along the respective, open supply duct 6*b*. In this case, the dyeing fluid 4 flows along the respective hollow support part 6*a* of the hollow support plate 6 and the corresponding reel-holder rods 7, through the reel-holder rods and the supported reels 8, to then again enter the chamber 3 of the structure 2.

Alternatively, the above described system that envisages the use of selection mechanisms 12 can also envisage at least one pump 10*a*, that can be switched between an operating position in which it induces the dyeing fluid 4 to pass through at least one reel-holder rod 7, preferably a plurality of reel-holder rods 7, and a non-operating position, in which the dyeing fluid 4 does not pass through at least one reel-holder rod 7. As can be seen in the annexed figures, the machine 1 additionally comprises heating means 13 that are operatively positioned inside of the chamber 3.

In the embodiment illustrated in the annexed figures, the heating means 13 are completely immersed in the dyeing fluid 4 to heat the latter and keep it at a predetermined temperature.

It should however be noted that the heating means 13 can also envisage any known settings other than the solution illustrated in the figures. For example, the heating means 13 can also be placed within the chamber 3, in direct contact with the structure 2, to transmit by conduction, the heat required for the dyeing process to the dyeing fluid 4.

The heating means 13 gradually heat the dyeing fluid 4 present within the chamber 3, so as to provide the latter with sufficient power for the colour to fasten to the yarn.

Specifically, the heating means 13 control the temperature of the dyeing fluid dispersing heat by conduction and convection.

Advantageously, the heating means 13 comprise at least one heat exchanger 13*a* that at least partially develops around the second recirculation mechanism 11, between the support plate 6 and the structure 2, so that the dyeing fluid 4 put into circulation though the action of the second recirculation mechanism 11, flows through the heat exchanger 13*a* before reaching the central transit channel 3*a*.

The machine and the procedure for the dyeing or reels of yarn according to this invention resolve the problems found in the prior art and bring significant benefits.

First of all, the above described machine ensures optimal contact of the dyeing fluid with the reels of yarn. In other words, the above machine configuration prevents reserved or preferential areas from forming within the dyeing compartment, as regards the temperature and the concentration of dye, which would respectively result in an insufficient or excessive deposit of dye with the undesirable respective effects of a lesser or greater intensity of colour on the yarn. In accordance with the described machine configuration, the dye is uniformly distributed to all parts of the yarn supported by the reels.

In particular, the aforementioned machine guarantees a sufficient number of yarn contacts or immersions per minute to ensure uniform dyeing.

Advantageously, the machine according to this invention is equipped with two fluid recirculation mechanisms, each duly configured and dedicated for the type of recirculation to be carried out.

The first recirculation mechanisms ensures the intermittent substitution of the bath that comes into contact with the yarn on the boundary layer and that reacts with it transferring heat and colour and reducing itself to a concentration.

The bath that flows in the period of time that the selection mechanisms is open and that comes into contact with the yarn from within, substantially has the same volume as the internal volume of the dyeing fluid suction and supply ducts, of the respective pump transit chambers, the reel-holder rod cavities, the internal part of the reels, in the space freed by the reels, between one coil of yarn and the other adjacent coils. Overall, the volume of said bath is equivalent to around 25-45% of the total volume of the dyeing fluid contained in the machine. Thus, with the same number of dye bath contacts with the yarn, the pump capacity of the first recirculation mechanism is equivalent to 25-45% of the pump capacity for the pumps envisaged for machines according to the prior art.

In order to prevent a marked reduction in the flow from resulting in a dramatic drop in the differential pressure required for the dyeing fluid to pass through the reels with possible preferential zones, the above described configuration for a selective supply of certain reel-holder rods rather than others, allows the differential pressure of the pump, required for the dye to pass through the reels to be maintained at or around optimal uniformity values. In this way, the pressure of the pump can be reduced, while at the same time ensuring the uniformity and the quality of the final dye.

It should also be taken into account that recirculation of the dye bath both within the chamber and externally to the reels of yarn, results in a highly homogenous dying fluid.

Furthermore, the continuous external contact of the homogenous dye bath and the yarn borne by the reels allows the external parts of the latter to be homogenously dyed. According to said configuration, it is no longer necessary to induce the continuous movement of the dyeing fluid through the reels of yarn, it being sufficient to induce the dyeing fluid to pass through the reels of yarn, at regular intervals, from an internal to external direction, as shown by arrows B in the annexed figures or in the opposite direction. In practice, it is no longer necessary to have high-capacity pumps equipped with flow deviation or inversion devices, a low-capacity pump being sufficient. Advantageously, dye bath circulation within the chamber and external to the dyeing reels, ensures uniform dyeing fluid temperature and a uniform concentration of colour in solution or dispersion.

In this case, the circulation put into effect by the second circulation mechanism must be high capacity but low head, since the circulation circuit or route comprises the entire volume of the chamber.

Advantageously, an axial, low-power pump can be used as an agitator. Circulation of the dye bath in the chamber in question affects around 55-75% of the total volume of the dyeing fluid in the machine. For this reason it is advantageous to mix said bath without inducing the dyeing fluid to pass through the reels and the reel-holder rods, which constitute an especially resistant obstacle.

In accordance with the above mentioned configuration, the power required by the system for each dyeing cycle and the stress on the yarn being dyed can significantly reduced. This latter advantage is somewhat important when it becomes necessary to dye delicate yarns that normally require special care and attention. In this way, even delicate yarns can be dyed, in all safety, while safeguarding their structural integrity.

The invention claimed is:

1. A method for dyeing reels of yarn and/or of textile fiber wound on a package, in machines for dyeing thereof, comprising:

transiting a dyeing fluid in accordance with a predefined route, wherein the transiting of the dyeing fluid comprises:

inducing, via one first recirculation mechanism, the dyeing fluid to pass through at least one reel-holder rod of the machine and through at least one reel of yarn and/or textile fiber wound on a package on the reel-holder rod, the reel-holder rod being immersed in the dyeing fluid;

stopping flow of the dyeing fluid through the reel-holder rod and the respective reel and/or textile fiber wound on a package, for a set period of time, the passing of the dyeing fluid through a plurality of reel-holder rods and the respective reels of yarn and/or the textile fiber wound on packages taking place simultaneously to stopping the flow of the dyeing fluid in another plurality of reel-holder rods of the machine;

inducing, via one second recirculation mechanism, different, separate and independent from the first recirculation mechanism, transit of the dyeing fluid around the reel-holder rods and the respective reels of yarn and/or textile fiber wound on packages, in accordance with at least one closed route.

2. The method as claimed in claim 1, wherein the flow of the dye through the reel-holder rod and the respective reel is stopped for a period of time not less than 3 seconds.

3. The method as claimed in claim 1, wherein the passage of the dyeing fluid through the reel-holder rods determines a selective and sequential supply of dyeing fluid to a number of reels, the supply of the dyeing fluid through the reels of each group being carried out for a period of time not in excess of 2 minutes, each supply cycle for each group of reels comprising at least a stasis, wherein the supply to the reels of the respective group is stopped for a set period of time in excess of 20 seconds.

4. The method as claimed in claim 2, wherein the flow of the dye through the reel-holder rod and the respective reel is stopped for a period of time not less than 5 seconds.

5. The method as claimed in claim 4, wherein the flow of the dye through the reel-holder rod and the respective reel is stopped for a period of time of 10 to 60 seconds.

6. The method as claimed in claim 3, the supply of the dyeing fluid through the reels of each group being carried out for a period of time not in excess of 30 seconds.

7. The method as claimed in claim 6, the supply of the dyeing fluid through the reels of each group being carried out for a period of time not in excess of 10 seconds.

* * * * *